United States Patent [19]

Moeck

[11] 3,988,956

[45] Nov. 2, 1976

[54] RECORDER

[76] Inventor: Hermann Moeck, Kreuzgarten 4, 31 Celle, Germany

[22] Filed: July 2, 1975

[21] Appl. No.: 592,387

[30] Foreign Application Priority Data

July 4, 1974 Germany ..... 2432423

[52] U.S. Cl. ..... 84/380 R

[51] Int. Cl.[2] ..... G10D 7/00

[58] Field of Search ..... 84/380, 383, 384

[56] References Cited

UNITED STATES PATENTS

| | | | |
|---|---|---|---|
| 3,030,845 | 4/1962 | Scherer | 84/384 |
| 3,178,986 | 4/1965 | Moeck | 84/380 UX |
| 3,643,538 | 2/1972 | Toyama | 84/380 UX |
| 3,805,665 | 4/1974 | Ouchi | 84/380 |
| 3,869,955 | 3/1975 | Yamaguchi | 84/380 |

*Primary Examiner*—John Gonzales

*Attorney, Agent, or Firm*—Dressler, Goldsmith, Clement, Gordon & Shore, Ltd.

[57] ABSTRACT

For recorders and like wood wind instruments various measures have been proposed to overcome the variations in musical tone which derive from the effects of moisture accumulating within the mouth-piece during playing. The provision of a blowing duct of which the surfaces are non-absorbent only leads to musical distortions because of irregularities in the air movements due to moisture droplets. The provision of adhered platelets of absorbent material on the blowing duct surfaces is found to have the defect that the adhesive bond is destroyed by swelling and contraction of the platelets, leading to a reduced useful life of the mouthpiece. The answer has been found in providing a core of dimensionally stable and absorbent material, such as hardened plaster of paris.

5 Claims, 1 Drawing Figure

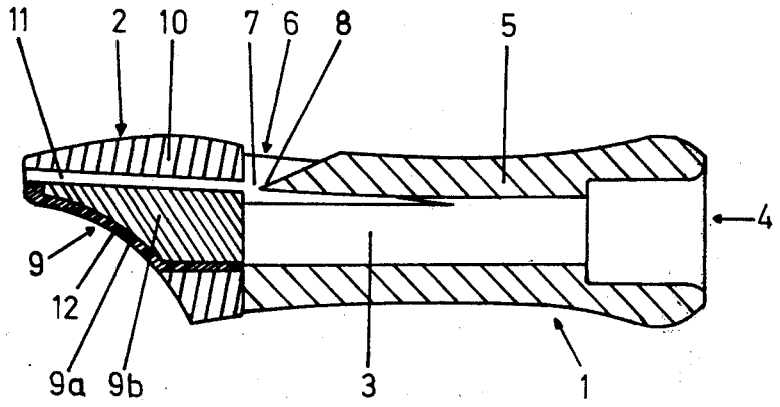
11
2
10
7
6
8
5
4
9
12
9a
9b
3
1

RECORDER

FIELD OF THE INVENTION

This invention relates to a wind-instrument, such as a recorder or block flute with a mouthpiece and a core disposed therein.

In general Recorders consist of two separate tubes, namely a body tube (subdivided in the larger instruments), which is equipped with the necessary scale holes, and of a headpiece pushed onto the body tube. The headpiece is furnished at its one end with a passage, into which the body tube possessing the scale holes is inserted, while into its other, outer end a core (also sometimes known as a block) is inserted, which together with a recess extending longitudinally of the headpiece defines the blowing passage and constitutes the lower wall thereof. This end of the headpiece which is furnished with the core is known as the mouthpiece.

BACKGROUND OF THE INVENTION

The material predominantly used for making recorders is wood, but ivory, plastics and metal are also used. All recorders made from these materials suffer from the common disadvantage of high susceptibility to condensation in the blowing duct of humidity from the breath. This breath humidity accumulates as large of small droplets on the walls of the blowing duct. This leads to a disturbance to the air passing through this blowing duct, resulting in the recorder becoming "husky." The forming of moisture deposits is to be expected after playing for some time. However when the atmosphere is cold or when the breath is especially humid, disturbing degree of precipitation may also occur after only a short period of play. Although wood is a material which to a certain extent, absorbs moisture, this property is not sufficient to prevent humidity-dependent effects upon the quality of the musical tone after a long period of play.

In the case of wooden recorders which are the predominant type, the effect of humidity in the blowing duct of the recorder is to have not only an instantaneous deleterious effect upon the play but also in the longer term it prevents a consistent and constant quality of tone. The walls of the blowing duct gradually lose their smooth surface by the continual influence of moisture. Fibrous and roughened regions are produced more or less rapidly, which modify the flow of air in the blowing duct. In addition, the continuous, intense influences of humidity during play, and the consequent drying out during intervals between play, lead to swelling and shrinking of the wood, which can modify the internal dimensions of the blowing duct in a manner adverse to the guidance of the wind through it. Since changes in dimensions of the order of only 0.02 mm lead to a detectable change in tone, recorders equipped in this manner lose the quality of their tone over a period of time.

Various different measures have already been proposed to counteract these wear phenomena in the blowing duct of wooden recorders. Thus it is known that the blowing duct may be fitted with a lining of a moisture-repellent material, intended for preventing the moisture from penetrating into the wood and producing the effects described. An increased resistance to wear in the blowing duct is indeed achieved by this measure, but the precipitation and retention of the breath humidity in the form of small droplets in the blowing duct is not prevented. Since the precipitating droplets remain completely on the surface of the lining and even the slight water absorption of the wood is suppressed, the capability for play of the instrument is in no way improved.

Another known and, by comparison, much better measure consists in the covering of the blowing duct, at least on two wall faces, with finely porous, ceramic, absorbent platelets. These platelets are glued to surfaces in the blowing duct and are capable of absorbing the condensing droplets so that the latter disappear from the surface of the blowing duct walls. In the long term however this measure, in itself good, does not prove to be entirely satisfactory. One reason is that the platelets, which, by their very nature cannot possess a large volume, rapidly become completely saturated with moisture. Another reason is that hitherto there is no adhesive which will satisfy the requirements imposed. As soon as the platelets have become saturated, they can no longer absorb any further humidity. It follows that from this instant onwards an adverse effect upon the playing capability of the recorder again occurs. In addition, the adhesive now becomes humid and like the wood beneath it commences to swell so that the inserted platelets become displaced. It has been found that in the course of time, the platelets, become partly loosened from their supporting surfaces in the blowing duct. In any case, the required dimensional accuracy of the blowing duct is lost as a result of this effect.

It is an object of the invention to overcome these disadvantages of the known recorders having an absorbent wall to the blowing duct.

SUMMARY OF THE INVENTION

Accordingly the present invention provides in a wind-instrument such as a recorder having a mouthpiece, a core disposed in the mouthpiece, a blowing duct in the mouthpiece, a lower wall face of the blowing duct being provided by the core, the improvement comprising forming at least that portion of the core which provides the lower wall face of the blowing duct from dimensionally stable and absorbent material.

For the purpose of the invention in principle it is possible for a large number of non-deforming absorbent materials to be used, such as, for example, porous ceramics or porous plastics. Surprisingly hardened plaster has been found to be an especially suitable material.

This proposal avoids the use of additional components such as platelets which need to be fixed by the adhesive in the vicinity of the blowing duct. Instead the absorption capability is incorporated into a single component which in any case must be present as a constituent of the recorder and which is not affixed by adhesive but is held as a tight fit in the central passage through the headpiece. All the deficiencies attributable to the unsatisfactory properties of adhesines now no longer occur.

In addition by this proposal, the volume of the absorbent material is substantially so increased that a larger quantity of introduced humidity can be absorbed. This enables the musical quality of the recorder itself to be maintained over unusually long periods of play. It is of course necessary with the recorder having an absorbent core for an opportunity to be provided for the blowing duct to be later dried out. This however does not present any problem, because the core, at least in its end surface which extends towards the body tube, possesses an additional (additional, by comparison to the glued-in platelets) evaporation surface, through which the absorbed humidity can escape.

Such a mouthpiece is now extremely easy to maintain in good repair in the case of damage to the porous core which constitutes approximately one half of the blowing duct boundary, since the core may be replaced in a simple manner. By contrast, the repair of damaged or loosened glued-in platelets provided to be extremely difficult.

In the preferred embodiment it has been found that hardened plaster, the use of which for woodwind instruments has hitherto never been proposed or considered, fulfills in an ideal manner the requirements for a porous, absorbent core. This material, especially in the form of a hard plaster of Paris or alpha-plaster, is not only very absorbent but is also still sufficiently hard and dimensionally stable when in the humid state. It has moreover been found that, especially if the plaster of Paris has wetting agent added to it, that even those droplets, which condense on the walls of the blowing passage which do not consist of plaster, disappear relatively rapidly. Apparently, this is because they "migrate" into the plaster. By the use of a porous material, preferably plaster of paris, for the entire core, the humidity problems in the blowing passage are thereby completely overcome, which is particularly surprising having regard to the fact that only the lower wall of the blowing duct is absorbent.

In order to prevent damage to the absorbent core material, especially hardened plaster of paris, when fitting the core into the headpiece of the recorder, it is a preferred feature of the invention that the core is furnished with a relatively thin jacket of a soft material preferably soft wood, which surrounds the absorbent material on all sides except for that portion extending along and defining a surface of the blowing duct. The surface of the core facing towards the body tube is not covered to allow for evaporation as stated above.

The facing of the outer end of the absorbent core also prevents the lips of the player from coming into contact with the core material. If the dimensionally stable and absorbent material is furnished with a surrounding jacket, then the facing layer favourably may be provided by this jacket. This has the particular advantage in manufacture that the outwardly facing surface of the absorbent core may be machined using a cylindrical saw without damage to the edges.

BRIEF DESCRIPTION OF THE DRAWINGS

For a fuller understanding of the invention a recorder headpiece incorporating the invention will now be described with reference to the accompanying drawing in which there is shown a longitudinal section of a headpiece.

DETAILED DESCRIPTION OF EMBODIMENTS

The drawing shows a headpiece 1 of a conventional wood recorder with a mouthpiece 2 situated thereon. The body tube adjoining the headpiece 1 on the right and containing scale holes is not illustrated in the drawing. The body tube may be of any usual or desired form of construction.

The headpiece 1 may also be constructed in the usual way. In the headpiece 1 there is a central passage 3 which widens at one end into a socket 4. The body tube is inserted in the usual way into this socket. A portion 6 is cut out of the wall 5 of the headpiece, whereby the lateral walls 7 of the cut-out and the lip portion with lip edge 8 are parts of the wall 5 of the headpiece.

At the other end of the passage 3 there is the mouthpiece 2. This mouthpiece comprises a core sleeve 10 machined out of the headpiece and a fitted-in core 9. The core 9 consists of a hard plaster component **9*b*, comprising a certain amount of added wetting agent, and of a wood surrounding jacket 9*a*. Between the core 9 and the core sleeve 10 there is the blowing duct 11, which possesses an approximately rectangular, inwardly tapering cross-section. The blowing duct is basically milled into the core sleeve 10 and is bounded on the lower side by the core 9** of plaster of paris, so that it is therefore bounded by two different materials.

The droplets precipitated in the blowing duct 11 are absorbed by the plasterr core 9. A wetting agent contained in the plastic reduces the surface tension and accelerates the absorbing action. This absorbed moisture can evaporate both through the surface of the core 9 in the blowing duct 11 and also through its end surface facing towards the central passage 3. An evaporation through the external surface 12 of the plaster core 9 at the mouthpiece is also possible through the thin wood surround.

The addition of a portion of wetting ageent to the plaster core also has the special advantage that the droplets which have precipitated on the upper wall of the blowing duct 11 become extraordinarily rapidly detached therefrom and are almost immediately absorbed by the absorbent lower wall of the blowing duct 11.

Tests with this recorder have shown that extraordinarily long playing times can be achieved without adversely affecting the tonal quality. In addition, when play has been completed a sufficient drying out of the water-absorbing core 9 takes place, so that the recorder is soon available for playing again. All the measures which it was hitherto necessary to use to retain the playing capacity of a recorder, such as for example intense blowing out, can be completely eliminated. In addition, the wear effects, which occured hitherto, such as moisture-produced erosion in the blowing duct and which in the course of time considerably reduced the tonal quality of the recorder, are reduced to a level which can scarcely be detected.

Moreover, the repair of any damage to the blowing duct has become considerably simpler to carry out, since the absorbent core with the resilient surrounding jacket may be held in place as a tight fit without using adhesives. In addition, a plaster of paris or ceramic core is considerbly more dimensionally stable when stored as a replacement than a pure wooden core, which is subjected to variations in the atmospheric humidity.

In the above, plaster of paris has been stated as the preferred material for the water-absorbing core 9. In principle however, any other similar material may be used, provided it possesses sufficient mechanical strength, sufficient stability in shape and dimensions especially when wet, and a sufficiently smooth surface, that is an especially fine porous structure.

In manufacturing the surrounded cores, various methods of production are possible, depending amongst other things upon the absorbent material used. If the absorbent material consists, for example, of ceramic, then the absorbent material is first brought with advantage to the required shape and then surrounded with a thin wooden layer. The core thus formed, which is accurate in its external dimensions, is then inserted into the mouthpiece. After the rounding of the mouthpiece has been milled, the outwardly facing surface of the core (that is the end surface 12) can again be faced. If plaster of paris is used as the absorbent material, then the process can start with a wooden cylinder having the external diameter of the final core. From this wooden cylinder, the void to be occupied by the plaster of paris is machined out by suitable material-removing processes. Then, this void is filled with a plaster mixture, whereby a suitable mould may be provided for the surface constituting the wall of the blowing duct. After the plaster of paris filling has set, and possibly after further machining of the surface constituting the wall of the blowing duct, the core is finished.

This use of a preformed jacket component, which is possible with plaster, also possesses the particular advantage that the facing on the end surface 12 may be provided as an integral part of the jacket. This is achieved by so shaping the space machined out of the hollow wooden cylinder that, after the rounding of the mouthpiece has been milled out in the vicinity of the end surface 12, a sufficient thickness of wooden wall remains.

What is claimed is:

1. In a wind-instrument such as a recorder having a mouthpiece, a core disposed in the mouthpiece, a blowing duct in the mouthpiece, a lower wall face of the blowing duct being provided by the core, the improvement comprising forming at least that portion of the core which provides the lower wall face of the blowing duct from hardened plaster of paris.

2. A recorder as defined in claim 1, wherein the core is wholly constituted of said hardened plaster of paris.

3. A recorder as defined in claim 1, wherein a wetting agent is added to said plaster of paris.

4. A recorder as defined in claim 1, comprising a jacket of material resilient to pressure for holding said core in place as a tight press fit without using adhesives and for acting as the mold for some of the surfaces of said core formed by filling said jacket with a liquid plaster of paris mixture, said jacket surrounding the surfaces of said plaster of paris which are to contact the mouthpiece and leaving exposed the lower wall face of the blowing duct.

5. A recorder as defined in claim 4, wherein said pressure resilient material is a light weight wood.

* * * * *